US007588836B2

(12) United States Patent
Nakamaru et al.

(10) Patent No.: US 7,588,836 B2
(45) Date of Patent: Sep. 15, 2009

(54) PHOSPHATE-TREATED ZINC-COATED STEEL SHEET

(75) Inventors: Hiroki Nakamaru, Fukuyama (JP); Chiyoko Tada, Chiba (JP); Kazumi Yamashita, Chiba (JP); Hideo Sasaoka, Chiba (JP); Chiaki Kato, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 130 days.

(21) Appl. No.: 11/597,117

(22) PCT Filed: Aug. 17, 2005

(86) PCT No.: PCT/JP2005/015300

§ 371 (c)(1),
(2), (4) Date: Nov. 20, 2006

(87) PCT Pub. No.: WO2006/019173

PCT Pub. Date: Feb. 23, 2006

(65) Prior Publication Data

US 2008/0063891 A1 Mar. 13, 2008

(30) Foreign Application Priority Data

Aug. 20, 2004 (JP) ..... 2004-240782

(51) Int. Cl.
*B32B 15/00* (2006.01)
*C25D 7/04* (2006.01)
*C25D 5/10* (2006.01)

(52) U.S. Cl. ..... 428/615; 428/607; 428/632; 428/633; 428/639; 428/649; 428/658; 428/659; 428/681; 428/684; 428/685

(58) Field of Classification Search ..... 428/607, 428/615, 632, 633, 639, 649, 658, 681, 684, 428/685, 659
See application file for complete search history.

(56) References Cited

U.S. PATENT DOCUMENTS 4,940,639 A * 7/1990 Ohshima et al. ..... 428/659
6,509,099 B1 1/2003 Urata et al.

FOREIGN PATENT DOCUMENTS

| | | | |
|---|---|---|---|
| EP | 1 067 212 | A | 1/2001 |
| EP | 1 142 699 | A1 | 10/2001 |
| JP | 01-312081 | A | 12/1989 |
| JP | 2000-313967 | A | 11/2000 |
| JP | 2001-179874 | A | 7/2001 |
| JP | 2002-285346 | A | 10/2002 |
| JP | 2004-143475 | * | 5/2004 |
| JP | 2004-143475 | A | 5/2004 |

OTHER PUBLICATIONS

Thaddeus Massalski, "Binary Alloy Phase Diagrams vol. 2", *American Society for Metals*, pp. 1772-1779, XP002475468 (1986), Ohio, USA.
Colin Smithells, "Metals Reference Book", *Butterworths Scientific Publications, Interscience Publishers Inc.*, p. 339, XP002475469 (1949), London, New York.

* cited by examiner

*Primary Examiner*—Timothy M Speer
*Assistant Examiner*—Gordon R Baldwin
(74) *Attorney, Agent, or Firm*—Frishauf, Holtz, Goodman & Chick, P.C.

(57) ABSTRACT

Disclosed is a phosphated galvanized steel sheet comprising a steel sheet, a zinc-plating layer of η single phase which is formed on at least one side of the steel sheet and contains Ni in an amount of not less than 10 ppm by mass and not more than the solubility limit thereof, and a phosphate layer which is formed on the zinc-plating layer and contains Mg in an amount of not less than 0.1 % by mass and less than 2.0 % by mass. Although this steel sheet is not subjected to sealing, it has corrosion resistance equivalent to or higher than those of conventional steel sheets which have been subjected to sealing, while having excellent blackening resistance.

2 Claims, No Drawings

PHOSPHATE-TREATED ZINC-COATED STEEL SHEET

This application is the United States national phase application of International Application PCT/JP2005/015300 filed Aug. 17, 2005.

TECHNICAL FIELD

The present invention relates to a phosphate-treated zinc-coated steel sheet suitable for a substrate steel sheet for painting. The phosphate-treated zinc-coated steel sheet is suitable for construction materials and materials for household electric appliances.

BACKGROUND ART

Steel sheets treated by zinc-coating or zinc-alloy-coating are used to the corrosion-resistant parts in construction materials and materials for household electric appliances. That type of steel sheet coated by zinc-containing coating is generally used after painting, not in as-coated state. For painting, a pretreatment is generally applied. A common pretreatment is phosphate treatment.

The phosphate treatment is conducted by bringing a steel sheet coated by zinc-containing coating into contact with an acidic solution containing phosphoric acid ion, thus forming a crystalline film containing zinc phosphate as the main component onto the surface of the coated surface. The phosphate treatment improves the adhesion with the painting film, thereby attaining substrate performance stable to various paintings. Owing to the advantageous performance, the steel sheet treated by phosphate and coated by zinc-containing coating has been widely used as a substrate steel sheet accompanied with painting for construction materials, materials for household electric appliances, and the like.

Sole phosphate treatment, however, gives insufficient corrosion resistance because of the presence of residual micropores. Accordingly, generally the sealing is applied after the phosphate treatment to maintain the corrosion resistance. A conventional method of the sealing is to bring the steel sheet into contact with an aqueous solution containing hexavalent chromium by spraying, dipping, or the like, followed by drying the attached aqueous solution. Since, however, the hexavalent chromium is classified to an environmentally regulated substance, there is wanted a sealing without using the aqueous solution containing hexavalent chromium, or other method to improve the corrosion resistance.

Responding to the requirement, JP-A-2000-313967, (the term "JP-A" referred to herein signifies the "Unexamined Japanese Patent Publication"), for example, proposed a phosphate-treated zinc-coated steel sheet which is prepared by forming a conversion-treated film composed of a crystalline substance containing phosphoric acid onto the surface of a zinc-containing coating, and then forming an amorphous phosphoric acid film onto the conversion-treated film. As another example, JP-A-2004-143475 proposed a phosphate-treated zinc-coated steel sheet which has a sealing film prepared by forming a zinc-phosphate treated film onto the surface of a zinc-containing coated steel sheet, and then by applying an aqueous solution containing at least one metallic compound selected from the group consisting of a copper compound, a titanium compound, and a zirconium compound, or further containing a polycondensation resin compound of bisphenol-A, amine, and formaldehyde, onto the zinc-phosphate treated film, followed by drying the film.

These disclosed technologies adopt sealing without using chromium.

All of the above-disclosed technologies, however, require heating to bake the applied aqueous solution during the step of forming the uppermost layer film. Consequently, these technologies have a drawback of necessity of an applying apparatus and a baking apparatus adding to the existed facilities to manufacture the phosphate-treated zinc-coated steel sheet, which increases the manufacturing cost.

There are trials for the technology to improve the corrosion resistance of the phosphate-treated film itself without sealing.

For example, JP-A-1-312081 proposed a metal material treated by phosphate and coated by zinc-containing coating, which is prepared by forming a zinc-containing coating layer onto the surface of a metallic material, and then by forming a film composed of a phosphate compound containing 0.1% by weight or more of Mg and preferably 5% by weight or less of Mg onto the coating layer. Furthermore, JP-A-2002-285346 proposed a steel sheet treated by zinc-phosphate and coated by zinc-containing coating, in which the zinc phosphate film on the zinc-containing coating layer contains 2% or more of Mg and 0.01 to 1% of at least one element selected from the group consisting of Ni, Co, and Cu, and the coating weight of the zinc phosphate film is 0.7 $g/m^2$ or more.

According to these disclosed technologies, however, the phosphate film layer as the uppermost layer contains Mg so that there is a problem of discoloration of the surface to black, (hereinafter also referred to as "blackening"), when the steel sheet is exposed to a high temperature and high humidity environment. Furthermore, according to the last example technology, since the zinc phosphate film contains large amounts of Ni, Co, and Cu, there arises a problem of darkening the tone of the zinc phosphate film.

Responding to the problems of conventional technologies, the present invention has an object to provide a phosphate-treated zinc-coated steel sheet which does not apply sealing, which has corrosion resistance equivalent to that of the conventional phosphate-treated zinc-coated steel sheet processed by sealing, and which has excellent blackening resistance.

DISCLOSURE OF THE INVENTION

The present invention provides a phosphate-treated zinc-coated steel sheet which has: a steel sheet; a zinc-coating layer of a single η-phase containing Ni in a range from 10 ppm by mass to the solid solution limit, being formed on at least one side of the steel sheet; and a phosphate-treated layer containing Mg in a range from not less than 0.1% by mass to less than 2.0% by mass, being formed on the zinc-coating layer.

The present invention also provides a phosphate-treated zinc-coated steel sheet having excellent corrosion resistance and blackening resistance, which steel sheet has a zinc-coating layer on at least one side of a steel sheet and a phosphate-treated layer as the upper layer to the zinc-coating layer, wherein the zinc-coating layer is a single η-phase containing Ni in a range from 10 ppm by mass to the solid solution limit, and the phosphate-treated layer contains Mg in a range from not less than 0.1% by mass to less than 2.0% by mass.

BEST MODE FOR CARRYING OUT THE INVENTION

To solve the above problems, the inventors of the present invention conducted detail studies about the variables affecting the corrosion resistance and the blackening resistance of the phosphate-treated zinc-coated steel sheet, and found that the phosphate-treated zinc-coated steel sheet having both the corrosion resistance and the blackening resistance can be manufactured without applying sealing by forming a zinc-coating layer of a single η-phase containing a specified amount of Ni onto the surface of the steel sheet, and then by forming a phosphate-treated layer containing a specified amount of Mg onto the zinc-coating layer.

According to the present invention, the zinc-coating layer formed on at least one side of the steel sheet is a single phase in which the crystal structure consists essentially of η-phase. According to the present invention, the η-phase contains a solid solution of Ni by the amounts from 10 ppm by mass to the solid solution limit. The presence of Ni solid solution by that amounts improves the blackening resistance of the phosphate-treated zinc-coated steel sheet. If the Ni amount in the zinc-coating layer of the single η-phase is less than 10 ppm by mass, when the phosphate-treated film containing Mg is formed on the coating, blackening cannot be prevented particularly in a high temperature and high humidity environment. Larger amount of Ni gives further significant effect for preventing blackening. Generally the Ni content is preferably 50 ppm by mass or more, and more preferably 100 ppm by mass or more. On the other hand, if the Ni content exceeds the Ni solid solution limit to the η-phase, δNi—Zn phase and γNi—Zn phase deposit to induce irregular appearance on the phosphate-treated layer as the upper layer. Although the cause of the irregularity in appearance is not fully analyzed, a presumable reason is that the variations in the phase structure of the zinc coating as the lower layer cause the non-uniformity in the zinc phosphate deposition state. The Ni solid solution limit to the η-phase signifies the upper limit of Ni content giving no detection of phase other than the η-phase in the zinc-coating layer by X-ray diffractometry.

With the above-findings, the present invention specifies the Ni content to a range from 10 ppm by mass to the solid solution limit. Since the solid solution limit in the electro-zinc coating varies with the composition of coating bath, the electrolytic condition, and the like, the upper limit of the Ni content cannot be unconditionally determined. Nevertheless, the upper limit is generally achieved by adjusting the composition of coating bath, the electrolytic conditions, and the like, thereby controlling the Ni content in the zinc-coating layer to less than 5% by mass, preferably less than 1% by mass, and most preferably not more than 0.1% by mass.

Although the coating weight of the zinc-coating layer according to the present invention can be adequately selected depending on the uses, the coating weight thereof is preferably 1 g/m$^2$or more from the point of corrosion resistance. Generally the coating weight thereof is approximately from 1 to 100 g/m$^2$, and preferably from 5 to 70 g/m$^2$.

The phosphate-treated zinc-coated steel sheet according to the present invention has a phosphate-treated layer containing Mg in a range from not less than 0.1% by mass to less than 2.0% by weight on the above-described zinc-coating layer. With that content of Mg, the time generating white rust during the salt spray test can be delayed, thus the corrosion resistance of phosphate-treated zinc-coated steel sheet can be improved without applying sealing. That is, when the Mg content is 0.1% by mass or more, the corrosion resistance becomes almost equal to that of the conventional phosphate-treated zinc-coated steel sheet after processed by sealing. On the other hand, even when the Mg content is increased to 2.0% by mass or more, the effect of improving the corrosion resistance saturates, and the blackening likely occurs strongly with the increase in the Mg content. Therefore, the Mg content in the phosphate-treated layer is specified to smaller than 2.0% by mass. From the point of blackening resistance, the Mg content is preferably 1.4% by mass or smaller, and more preferably in a range from 0.5 to 1.0% by mass. For the phosphate-treated layer according to the present invention, there occurs no problem even when the phosphate treatment solution contains other cations, as inevitable impurities, such as Ni, Mn, and Co up to the approximate amounts of from 0.01 to 0.4% by mass.

The coating weight of the phosphate-treated layer according to the present invention is preferably 0.2 g/m$^2$ or more, more preferably 1.0 g/m$^2$ or more, and most preferably 1.5 g/m$^2$ or more. If the coating weight thereof is 0.2 g/m2 or more, both the corrosion resistance and the paint adhesion can fully be attained. Since the above-effect attained by the increase in the coating weight saturates at 3 g/m$^2$ or more, the upper limit of the coating weight is preferably 3 g/m$^2$ in view of economy.

A preferred method for manufacturing the phosphate-treated zinc-coated steel sheet according to the present invention is described below. According to the present invention, it is preferred that the zinc coating is applied to at least one side of the steel sheet as the substrate, and then the phosphate treatment for forming the phosphate-treated layer is applied onto the zinc coating.

As the pretreatment, it is preferred to apply zinc-coating after applying, at need, electrolytic degreasing, pickling, washing with water, and the like to clean the surface of the steel sheet.

Examples of applicable method for forming the zinc-coating layer according to the present invention are vacuum vapor deposition method, hot dip coating method, and electro-coating method. Although any of these methods can be used, the electro-coating method is preferred from the point of easiness of controlling the Ni content in the zinc-coating layer. The following description is the case of electro-coating method as an example.

For instance, a Ni source is added to an electro-zinc coating bath having an ordinary composition, and electro-coating is applied to at least one side of a steel sheet to form a zinc-coating layer of a single η-phase containing Ni in a range from 10 ppm by mass to the solid solution limit. For the case of electro-coating method, the phase structure of the formed coating film is generally in a non-equilibrium state, thus the Ni in the η-phase can form solid solution in a super-saturation state. As a result, the Ni quantity in the solid solution state can be easily controlled by adjusting the coating bath composition, the electrolytic condition, and the like. Therefore, the electro-coating method is preferred.

That type of electro-zinc coating bath is not specifically limited, and ordinary bath can be applied if only the pure-zinc-coating layer can be formed. Examples of applicable bath are a zinc sulfate solution and a zinc chloride solution. The Ni source is not specifically limited if only the Ni source generates Ni ion in the zinc-coating bath. Examples of applicable Ni source are nickel sulfate and nickel chloride. Responding to the Ni content in the zinc-coating layer, it is preferable to adjust the adding amount of Ni source to adjust the Ni amount in the zinc-coating bath. The electric conditions such as current density are adjusted responding to the conditions such as the coating weight of zinc-coating layer and the Ni content. Regarding the coating weight of zinc-coating layer, 1 g/m$^2$ or more is preferable because sufficient corrosion resistance is attained, and more preferably from 1 to 100 g/m$^2$.

In the phosphate-treatment step, a phosphate-treated layer containing Mg in a range from not less than 0.1% by mass to less than 2.0% by mass is formed. The phosphate-treated layer is preferably formed by bringing the zinc-coating layer contact with the phosphate treatment solution by a known method such as spray and dipping. To add Mg to the phosphate-treated layer, the present invention preferably uses a phosphate treatment solution having the mass ratio of Mg ion concentration to Zn ion concentration, ($Mg^{2+}/Zn^{2+}$), of more than 0.05. The ratio ($Mg^{2+}/Zn^{2+}$) is preferably 5 or less. The Mg amount entering the phosphate-treated layer is affected by, other than ($Mg^{2+}/Zn^{2+}$) in the treatment solution, Zn concentration, liquid temperature, pH, and other variables of the treatment solution. The above-described range of ($Mg^{2+}/Zn^{2+}$) is specifically preferred under the condition of normal chemical conversion treatment, for example, 0.5 to 5 g/l of Zn concentration, 30° C. to 70° C. of liquid temperature, and 1.0 to 2.5 of pH. If the ($Mg^{2+}/Zn^{2+}$) is 0.05 or more, the phosphate-treated layer containing 0.1% by mass or more of Mg is easily formed. Also ($Mg^{2+}/Zn^{2+}$) less than 5 easily maintains the Mg amount in the phosphate-treated layer in an appropriate range. To keep the ($Mg^{2+}/Zn^{2+}$) in the phosphate treatment solution to an appropriate level, the Mg salt is required to be dissolved to an appropriate concentration. Accordingly, the selection of anion to Mg becomes important. Examples of applicable Mg ion source are magnesium hydroxide, magnesium carbonate, magnesium sulfate, magnesium chloride, and/or magnesium nitrate. However, use of magnesium hydroxide, magnesium carbonate, and magnesium sulfate likely fails to attain sufficient solubility in water. Although the magnesium chloride has sufficient solubility in water, high concentration of chlorine ion enters the phosphate-treatment solution together with Mg ion, thus may reversely affecting the formation of phosphate film. Accordingly, magnesium nitrate is suitable for the Mg ion source. The phosphate-treatment solution according to the present invention preferably uses a commercially available treatment solution which contains zinc ion and phosphoric acid ion, and further contains accelerator and the like. Examples of that kind of treatment solution are PB3312M (trade name, a product of Nihon Parkerizing Co., Ltd.) and a product containing above-described Mg source at a specific amount. The coating weight of the phosphate-treated layer is preferably adjusted to a range from 0.2 to 0.3 g/$m^2$. The adjustment can be conducted by a known method to control the contact time between the zinc-coating layer and the phosphate-treatment solution.

Prior to the phosphate treatment, surface adjustment on the zinc-coating layer is preferably given. A preferred surface treatment is to spray a titanium-colloid activation treatment agent. An example of the titanium-colloid activation treatment agent is PREPAREN ZN (trade name, a product of Nihon Parkerizing Co., Ltd.)

EXAMPLES

The present invention is described in more detail referring to the examples.

Test plates having the dimensions of 210×100 mm were cut from a cold-rolled steel sheet of 1.0 mm in thickness. These test plates were subjected to pretreatment. That is, firstly the test plates were treated by electrolytic degreasing in an alkali-degreasing solution (70° C.) containing 60 g/l of sodium orthosilicate using a stainless steel sheet as the counter electrode at 5 A/$dm^2$ of current density for 30 seconds. Then, the test plates were washed with water, and were dipped into an aqueous solution of 30 g/l sulfuric acid (30° C.) for 5 seconds to conduct pickling, followed by washing with water. After the pretreatment, the test plates were subjected to electro-zinc coating to form a zinc-coating layer at 5 to 40 g/$m^2$ of coating weight on one side of each test plate.

The electro-zinc coating was conducted in the following steps.

To a zinc-coating solution containing 440 g/l of zinc sulfate heptahydrate, varied amounts of nickel sulfate hexahydrate as the Ni source were added in a range from 0 to 10 g/l, thus forming coating baths having different Ni contents each other. The pH of each zinc-coating solution was adjusted to 1.5 using sulfuric acid. The temperature of the bath was regulated to 50° C. The electro-zinc coating was conducted under the conditions of: a Ti plate coated by iridium oxide as the counter electrode in parallel arrangement relating to the test plate at 10 mm in electrode spacing; circulation of the coating solution at 1.5 m/s of flow velocity between electrodes; and 70 A/$dm^2$ of current density.

After forming the zinc-coating layer on the surface of test plate, the zinc-coating layer was washed with water.

Then, as the pretreatment of the phosphate treatment, the surface of the zinc-coating layer was treated by a surface treatment agent (PREPAREN Z: trade name, a product of Nihon Parkerizing Co., Ltd.)

To the surface-treated zinc-coating layer, a zinc phosphate treatment solution (PB3312M (trade name, a product of Nihon Parkerizing Co., Ltd.) with the addition of magnesium nitrate (3.5 g/l of Zn concentration, 60° C. of liquid temperature, and 2.2 of pH) was sprayed, followed by washing with water and drying to form the phosphate-treated layer. The adding amount of Mg source was varied to prepare the phosphate-treatment solutions having different Mg contents from each other. The coating weight of the phosphate-treated layer was varied by changing the spray period.

Thus the phosphate-treated zinc-coated steel sheets (test plates) were prepared.

As Comparative Examples, a pure zinc-coating layer which contained no Ni was formed by applying ordinary zinc-coating to a test plate same with that for Examples. Furthermore, ordinary phosphate treatment was applied to the pure zinc-coating layer containing no Ni to form a phosphate-treated layer containing no Mg on the pure zinc-coating layer. Thus prepared test plate was named the test plate No. 24. To a test plate equivalent to the test plate No. 24, sealing was applied using an aqueous solution composed mainly of chromic acid (VI) anhydride (LN62: trade name, a product of Nihon Parkerizing Co., Ltd.). Thus prepared test plate was named the test plate No. 26. Other conditions such as the pretreatment of coating, the surface preparation treatment, and the electro-coating condition were similar with those of Examples.

The prepared test plates were tested to identify the appearance of treated surface, the coating weight of zinc-coating layer and phosphate-treated layer, the phase structure of zinc-coating layer, the corrosion resistance, and the blackening resistance. The methods for identifying individual characteristics are the following.

(1) Appearance of Surface of Steel Sheet

The homogeneity of the surface of steel sheet after the phosphate treatment, (test plate), was evaluated by visual observation. Homogeneous surface was evaluated as ○, and non-homogeneous surface was evaluated as X.

(2) Coating Weight of Zinc-Coating Layer and Phosphate-Treated Layer

Coating weight of and Ni content of the zinc-coating layer were determined in accordance with the methods for testing the coating weight specified by JIS H0401-1999. That is, the zinc-coating layer was dissolved in a hexamethylenetetramine solution, and which dissolved solution was then analyzed by the electric-heating atomic absorption spectrochemical analyzer specified by JIS K0120-1993. The coating weight of phosphate-treated layer was determined by the gravimetric method by dissolving the phosphate-treated layer in an aqueous solution of ammonium dichromate. The Mg content in the phosphate-treated layer was determined by dissolving the phosphate-treated layer in an aqueous solution of ammonium dichromate, and which dissolved solution was then analyzed by the inductively coupled plasma emission spectrochemical analysis (ICP analysis).

(3) Phase Structure of Zinc-Coating Layer

Whether the phase structure and the Ni content in the zinc-coating layer were not above the solid solution limit or above was determined by the X-ray diffractometry. The judgment was given by the presence/absence of peak other than that of η-phase. When the detected peaks were only the peak of α-Fe originated from the substrate steel sheet and the peak of η-Zn phase, the evaluation was given as ○. When the detected peaks were the peak of δ-phase or γ-phase of Zn—Ni alloy, other than the peaks of α-Fe and the η-Zn phase, the evaluation was given as X.

(4) Corrosion Resistance

Test pieces having the dimensions of 100×50 mm were cut from the prepared test plate. The edges and the rear side of the test piece were sealed with tape. Then, the test piece was subjected to salt spray test in accordance with the specification of JIS Z 2371-2000. Regular observations were given to the surface of the test piece to determine the time when the area of white-rust generation becomes 5% of the total evaluation area on the test piece, (white-rust generation time), to evaluate the corrosion resistance. When the white-rust generation time was 24 hours or more, the evaluation was given as ◎. When the white-rust generation time was less than 24 hours and not less than 8 hours, the evaluation was given as ○. When the white-rust generation time was less than 8 hours and not less than 4 hours, the evaluation was given as Δ. When the white-rust generation time was less than 4 hours, the evaluation was given as X.

(5) Blackening Resistance

Test pieces having the dimensions of 100×50 mm were cut from the prepared test plate. Using a spectroscopic color difference meter SQ2000 (manufactured by Nippon Densyoku Industries Co., Ltd.), firstly the initial lightness ($L_0$ value) of the test piece was determined. Then, the test piece was allowed to standing in a thermohygrostat at 80° C. and 95% RH for 24 hours, and then the lightness ($L_t$ value) was determined. The difference between $L_t$ value and $L_0$ value, ($\Delta L=L_t-L_0$), was derived. The blackening resistance was evaluated in the following. When $\Delta L \geqq -1$, the evaluation was given as ◎. When $-1>\Delta L \geqq -2$, the evaluation was given as ○. When $-2>\Delta L \geqq -4$, the evaluation was given as Δ. When $-4>\Delta L$, the evaluation was given as X. The results are given in Table 1.

Table 1 shows that the phosphate-treated zinc-coated steel sheets, without treated by sealing, in Examples of the present invention have corrosion resistance equivalent to or higher than that of the conventional phosphate-treated steel sheets treated by sealing, and have excellent blackening resistance. To the contrary, Comparative Examples which are outside the technological range of the present invention are inferior in any of corrosion resistance, blackening resistance, and appearance of surface.

TABLE 1

| | Zinc-coating treatment | Phosphate treatment | | Zinc-coating layer | | | Phosphate-treated layer | | Test result | | | |
|---|---|---|---|---|---|---|---|---|---|---|---|---|
| Test plate No. | Adding amount of Ni in the coating solution (as Ni) (ppm by mass) | $Mg^{2-}/Zn^{2-}$ in the treatment solution | Sealing Applied/ Not applied | Ni content (ppm by mass) | Coating weight ($g/m^2$) | Phase structure | Mg content (% by mass) | Coating weight ($g/m^2$) | Appearance | Corrosion resistance | Blackening resistance | Remark |
| 1 | 5 | 0.06 | Not applied | 10 | 5 | ○ | 0.1 | 2.5 | ○ | Δ | ◎ | Example |
| 2 | 5 | 0.12 | Not applied | 10 | 10 | ○ | 0.2 | 2.0 | ○ | Δ | ○ | Example |
| 3 | 5 | 0.60 | Not applied | 10 | 20 | ○ | 0.5 | 1.7 | ○ | ○ | ○ | Example |
| 4 | 5 | 1.80 | Not applied | 10 | 30 | ○ | 1.0 | 2.0 | ○ | ◎ | ○ | Example |
| 5 | 5 | 3.00 | Not applied | 10 | 40 | ○ | 1.4 | 2.1 | ○ | ◎ | Δ | Example |
| 6 | 5 | 4.50 | Not applied | 10 | 40 | ○ | 1.9 | 2.3 | ○ | ◎ | Δ | Example |
| 7 | 15 | 0.06 | Not applied | 30 | 15 | ○ | 0.1 | 2.8 | ○ | Δ | ◎ | Example |
| 8 | 15 | 0.12 | Not applied | 30 | 20 | ○ | 0.2 | 1.8 | ○ | Δ | ○ | Example |
| 9 | 25 | 2.75 | Not applied | 50 | 30 | ○ | 1.3 | 2.0 | ○ | ◎ | ○ | Example |
| 10 | 25 | 4.50 | Not applied | 50 | 30 | ○ | 1.9 | 1.8 | ○ | ◎ | Δ | Example |
| 11 | 50 | 0.06 | Not applied | 100 | 20 | ○ | 0.1 | 1.8 | ○ | Δ | ◎ | Example |
| 12 | 50 | 0.12 | Not applied | 100 | 20 | ○ | 0.2 | 1.0 | ○ | Δ | ◎ | Example |
| 13 | 50 | 0.60 | Not applied | 100 | 20 | ○ | 0.5 | 1.2 | ○ | ○ | ◎ | Example |
| 14 | 50 | 1.80 | Not applied | 100 | 20 | ○ | 1.0 | 1.6 | ○ | ◎ | ○ | Example |
| 15 | 50 | 2.90 | Not applied | 100 | 20 | ○ | 1.4 | 1.5 | ○ | ◎ | ○ | Example |
| 16 | 50 | 4.30 | Not applied | 100 | 20 | ○ | 1.8 | 1.2 | ○ | ◎ | ○ | Example |

TABLE 1-continued

| Test plate No. | Zinc-coating treatment: Adding amount of Ni in the coating solution (as Ni) (ppm by mass) | Phosphate treatment: $Mg^{2-}/Zn^{2-}$ in the treatment solution | Sealing Applied/ Not applied | Zinc-coating layer: Ni content (ppm by mass) | Zinc-coating layer: Coating weight ($g/m^2$) | Zinc-coating layer: Phase structure | Phosphate-treated layer: Mg content (% by mass) | Phosphate-treated layer: Coating weight ($g/m^2$) | Test result: Appearance | Test result: Corrosion resistance | Test result: Blackening resistance | Remark |
|---|---|---|---|---|---|---|---|---|---|---|---|---|
| 17 | 200 | 2.60 | Not applied | 400 | 20 | ○ | 1.3 | 0.5 | ○ | ○ | ◎ | Example |
| 18 | 200 | 4.30 | Not applied | 400 | 20 | ○ | 1.8 | 0.5 | ○ | Δ | ○ | Example |
| 19 | 200 | 1.80 | Not applied | 400 | 20 | ○ | 1.0 | 1.0 | ○ | ◎ | ◎ | Example |
| 20 | 200 | 0.60 | Not applied | 400 | 20 | ○ | 0.5 | 1.5 | ○ | ○ | ◎ | Example |
| 21 | 200 | 0.12 | Not applied | 400 | 20 | ○ | 0.2 | 2.0 | ○ | Δ | ○ | Example |
| 22 | 200 | 0.12 | Not applied | 400 | 20 | ○ | 0.2 | 3.0 | ○ | Δ | ○ | Example |
| 23 | —* | 6.00 | Not applied | —* | 20 | ○ | 2.2 | 1.2 | ○ | ○ | X | Comparative example |
| 24 | —* | 0 | Not applied | —* | 10 | ○ | 0* | 1.2 | ○ | X | ○ | Comparative example |
| 25 | 25000 | 0.60 | Not applied | 50000 | 20 | X | 0.5 | 1.2 | X** | ○ | ○ | Comparative example |
| 26 | —* | 0 | Applied | —* | 20 | ○ | 0* | 1.2 | ○ | ○ | ○ | Comparative example |

*Not added
**Presence of region giving locally different color tones irregularly

INDUSTRIAL APPLICABILITY

According to the present invention, without applying the sealing treatment, a phosphate-treated zinc-coated steel sheet having corrosion resistance equivalent to or higher than that of the conventional phosphate-treated zinc-coated steel sheets treated by sealing, and having excellent blackening resistance can be easily manufactured at a low cost. Furthermore, the present invention provides remarkable industrial effect in terms of non environmental pollution owing to the elimination of chromate treatment and of manufacturing phosphate-treated zinc-coated steel sheet having excellent characteristics.

The invention claimed is:

1. A non-sealed phosphate-treated electro zinc-coated steel sheet consisting essentially of: a steel sheet; a electro zinc-coating layer of a single η-phase containing Ni in a range from 10 ppm by mass to 400 ppm by mass, being formed on at least one side of the steel sheet; and a phosphate-treated layer containing Mg in a range from 0.5% by mass to 1.3% by mass, being formed on the electro zinc-coating layer.

2. The phosphate-treated electro zinc-coated steel sheet according to claim 1, wherein the phosphate-treated layer contains Mg in a range from 0.5% by mass to 1.0% by mass.

* * * * *